United States Patent [19]

Sperner et al.

[11] 4,358,663

[45] Nov. 9, 1982

[54] HEATER PLUG FOR DIESEL ENGINES

[75] Inventors: Franz Sperner, Hanau; Fritz Aldinger, Rodenbach; Wilhelm Zwergel, Freigericht, all of Fed. Rep. of Germany

[73] Assignee: W. C. Heraeus GmbH, Hanau, Fed. Rep. of Germany

[21] Appl. No.: 111,433

[22] Filed: Jan. 11, 1980

[30] Foreign Application Priority Data

Jan. 12, 1979 [DE] Fed. Rep. of Germany ..... 2900984

[51] Int. Cl.[3] ..... F23Q 7/22

[52] U.S. Cl. ..... 219/270; 123/145 A; 219/267; 219/523; 219/543; 361/266

[58] Field of Search ..... 219/205, 260, 267, 270, 219/523, 543, 553; 123/145 R, 145 A, 146; 431/66, 262; 361/264, 265, 266

[56] References Cited

U.S. PATENT DOCUMENTS

| | | | |
|---|---|---|---|
| 1,480,011 | 1/1924 | Roden | 361/266 X |
| 2,404,841 | 7/1946 | Hess et al. | 361/266 X |
| 2,484,544 | 10/1949 | Bennett et al. | 219/270 |
| 2,487,752 | 11/1949 | Cohn | 361/266 |
| 2,487,753 | 11/1949 | Cohn | 361/266 X |
| 2,492,755 | 12/1949 | McCollum | 361/266 X |
| 2,530,827 | 11/1950 | Lakota et al. | 219/270 |
| 2,708,253 | 5/1955 | Cohn | 219/270 |
| 2,846,557 | 8/1958 | Schulze et al. | 219/267 |
| 2,884,920 | 5/1959 | Moule et al. | 123/145 A |
| 3,017,541 | 1/1962 | Lawser | 219/267 |
| 3,161,748 | 1/1965 | Testerini | 361/264 X |
| 3,297,914 | 1/1967 | Saintsbury | 219/270 X |
| 3,393,038 | 7/1968 | Burkhalter et al. | 431/66 |
| 3,434,012 | 3/1969 | Rademacher | 361/266 X |
| 3,521,213 | 7/1970 | Hardy | 219/270 X |
| 3,679,473 | 7/1972 | Blatchford et al. | 219/543 X |
| 3,737,625 | 6/1973 | Martin | 219/553 |
| 3,812,324 | 5/1974 | Faffaelli et al. | 219/553 |
| 3,911,326 | 10/1975 | Ohlsson | 361/264 |
| 4,107,510 | 8/1978 | Tombs et al. | 219/270 |
| 4,112,577 | 9/1978 | Mann | 29/611 |

FOREIGN PATENT DOCUMENTS

| | | | |
|---|---|---|---|
| 1215013 | 12/1970 | United Kingdom | 219/270 |

OTHER PUBLICATIONS

Helmut Weil, "Anlasshiftsmittal für Dieselmotoren", *Bosch Technische Berichte,* 1977, vol. 5, Nos. 5–6, pp. 279–286.

*Primary Examiner*—Volodymyr Y. Mayewsky
*Attorney, Agent, or Firm*—Sprung, Horn, Kramer & Woods

[57] ABSTRACT

A heater plug comprising a heater coil connected to a terminal pin, said terminal pin maintained in gas-tight manner at least in part within and insulated from a plug shell, at least the surface of said heater coil formed by a metal or a base alloy of a metal of the platinum group said heater coil supported by heat resistant electrically insulating rod-like or tubular supporting body heater coil surrounded by a protective tube.

The heater plug is useful as a starting aid for diesel engines and other internal combustion engines, especially those without spark ignitions.

27 Claims, 6 Drawing Figures

HEATER PLUG FOR DIESEL ENGINES

BACKGROUND OF THE INVENTION

1. Field of the Invention

The invention relates to a heater plug for Diesel engines or internal combustion engines without spark ignition, particularly for use as a preheating cold-starting aid.

2. Discussion of Prior Art

The state of the art in this area has been reviewed extensively in the article by Helmet Weil entitled "Anlasshilfsmittel für Dieselmotoren" (Starting aids for diesel engines) in the journal BOSCH Technische Berichte, vol. 5, Nos. 5–6, pp. 279 to 286. The term heater plug is applied to both the hot-wire plug and the hot-pin plug. In the section on starting aids in the combustion chamber, a hot-pin plug is described and illustrated in FIG. 3; and a high-intensity hot-pin plug shown in FIG. 8 is described as a starting aid in the intake manifold. In both cases a heater coil is used which is embedded by means of an insulating magnesium oxide powder in a heater tube made of heat-resistant steel. The heater coil itself is made of a resistance material on a nickel-chromium or chromium-iron-aluminum basis.

In FIG. 4, temperature and current are plotted against time. Accordingly, the preheating time of prior-art heater plugs ranges from 10 to 50 sec, depending on the ambient temperature. These preheating times are based on an ambient temperature between about +20° and −20° C. In colder weather, however, preheating times of up to 2 minutes have been observed in practice. It has been sought to reduce these times by the use of special electrical auxiliary apparatus, such as a current regulator. This approach, however, is rather costly.

It is an object of this invention, therefore, to provide a heater plug which has a reduced preheating time also when used in winter in northern latitudes, for example.

SUMMARY OF THE INVENTION

The foregoing objects are accomplished by a heater plug according to the invention, which heater plug comprises a heater coil connected to a terminal pin, said terminal pin maintained in gas-tight manner at least partially within and insulated from a plug shell, at least the surface of said heater coil formed of a metal or a base alloy of a metal of the platinum group, said heater coil supported by a heat resistant, electrically insulated rod-like or tubular supporting body, said heater coil surrounded by a protective tube.

In accordance with this invention there is provided an improved heater plug especially for use in diesel engines and internal combustion engines, especially those which are not equipped with a spark ignition. The heater coil of the heater plug can have any of a number of forms and in one form is preferably formed by a wire winding on the supporting body. The heater coil can be formed of a thin layer applied helically to the supporting body and can have a layer thereon provided by vapor deposition, sputtering, imprinting, flame-spraying or galvanic or chemical precipitation methods.

Between the heater coil and the electrically insulating, heat resistant tubular or rod-like supporting body, there can be provided an intermediate layer at least over the area of the coil. The heater coil can be disposed on the supporting body by having a layer thereon which is baked onto the supporting body.

The heater coil has at least its surface formed of a metal of the platinum group or a base alloy of such platinum group metal. The heater coil can, however, also be made entirely of a metal of the platinum group or an alloy comprising such platinum group metal. Alternatively, the heater coil can have an internal core made of one substance with its surface made of a metal or alloy of the platinum group metal.

Further characteristics of the invention will become apparent from the appended claims.

Specifically included in the invention are all combinations and subcombinations of the characteristics described, shown and claimed, both with one another and with known characteristics.

An embodiment of the invention is shown diagrammatically in the accompanying drawing without the invention being limited thereto.

BRIEF DESCRIPTION OF DRAWINGS

Referring to the amended drawings wherein like reference numerals represent like parts.

DESCRIPTION OF SPECIFIC EMBODIMENT

Figure 1:
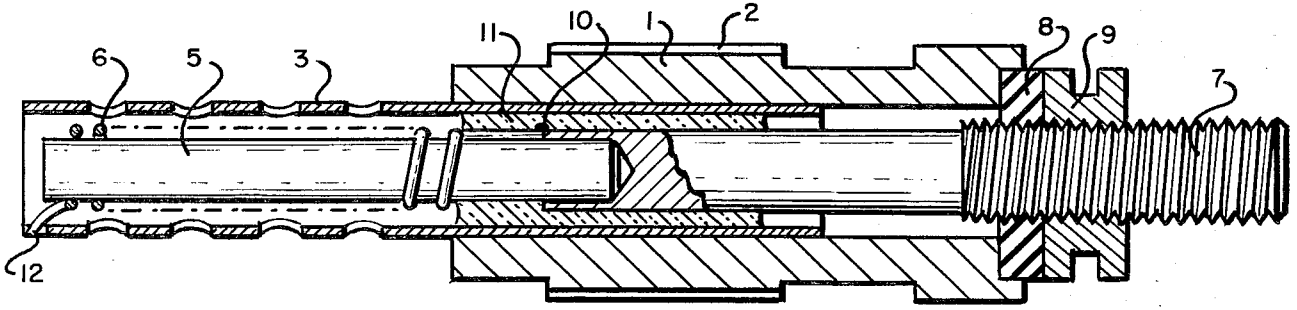
FIG. 1 illustrates the construction of the heater plug in accordance with the invention with a portion of the heater coil 6 removed for purposes of simplicity.

As may be seen from FIG. 1, the heater plug in accordance with the invention is formed of a metallic plug shell 1 with an external screw thread 2 permitting it to be screwed in place at the point of use, as in the combustion chamber, for example. A protective tube 3 made of a heat-resistant metal or metal alloy is fastened in the shell 1 by being forced into it, for example. Disposed within the protective tube is the supporting body 5 for the heater coil 6, said body being fixed to the terminal pin 7, likewise preferably by being forced into it. The terminal pin 7 for the electrical connection is electrically insulated from the plug shell 1 by an insulating disk 8 which is pressed against said shell by a round nut 9 to provide a gas seal. The heater coil 6 is soldered to the terminal pin 7 at 10. A glass seal 11 joins the terminal pin 7 to the protective tube 3 and also provides electrical insulation.

As is apparent from FIG. 1, the protective tube 3, which serves to protect the exposed heater coil against mechanical damage as the heater plug is inserted and removed, is open at one end and extends beyond the supporting body 5 for the heater coil. The protective tube is provided with openings over its circumference which are of such number and size that sufficient fuel and air are able to pass to the heater coil to form a combustible mixture. Current which is applied to the terminal pin at a voltage ranging from 6 to 14 volts flows directly through the heater coil and by way of protective tube and plug shell to ground. At its end remote from the soldered spot 10, the heater coil is fastened to the protective tube at 12 by being forced into it, for example.

In the embodiment shown in FIG. 1, a heater wire of a diameter of 200 to 400$\mu$, e.g., 300$\mu$ is wound onto the supporting body 5, made of a ceramic material, vitreous silica, a high-silica glass or a vitrified ceramic material.

the heater wire is formed of a metal from the platinum group or of an alloy comprising at least one such metal. Generally, there is at least 70 weight percent of platinum group metal and up to 100 weight percent. Preferred are platinum-rhodium alloys with up to 40 percent rhodium, and in particular a platinum alloy with 10 weight percent rhodium. However, other alloys from the group of platinum metals, that is to say, alloys containing ruthenium, rhodium, palladium, osmium, iridium or platinum, are also suited for use. Iridium, ruthenium and osmium are adapted to increase the heat resistance while platinum and palladium are used especially because of their chemical stability and good fabricating properties. The cost of the particular precious metal, and hence the amount in which it is used, is also an important consideration.

However, when high chemical stability and high heat resistance are required, the metals which are stable to about 1100° C. and higher, and particularly the high-temperature-melting metals from the group comprising niobium, tantalum, molybdenum and tungsten, used alone or as alloys of these metals, are less well suited, even though they are lower in cost than the precious metals or their alloys.

Figure 1C:
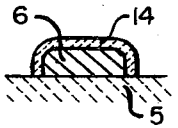
FIG. 1*a*–1*d* show enlarged cross-sections of various embodiments for the heater coil 6 and its relationship to the supporting body 5.
Figure 1D:
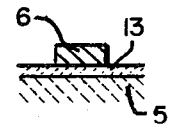
Figure 1B:
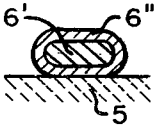
Figure 1A:
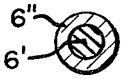

In accordance with another embodiment, there is therefore proposed a heater coil made of a high-temperature-melting metal, or of an alloy having at least one of said metals as a core, which is covered with a cladding or jacket of a metal from the platinum group or of an alloy comprising at least one metal from the platinum group. Such an embodiment is shown in FIG. 1*a*. In this embodiment, the core 6′ is formed of a high-temperature-melting, preferably molybdenum, and the cladding or jacket 6″ of platinum or an alloy comprising at least one metal from the platinum group. The cladding or jacket 6″ has a thickness of from 5 to about 50μ, and preferably of 25μ, to satisfy the aforesaid requirements. The core has a diameter of 150 to 400μ, preferably 250 to 300μ. Because of their specific electrical resistance, molybdenum or tungsten are preferred as core metal over the other high-melting metals.

In place of a wire, a strip may be used to wind the heater coil. Such a strip is shown in FIG. 1*b*. The core 6′ has a cross-sectional area of about 0.02 to 0.10 $mm^2$, e.g., 0.03 $mm^2$, and the cladding or jacket 6″ is of the same thickness as that of FIG. 1*a*.

Instead of being in the form of a wire or strip, the conductor for the heater coil 6 may be formed of a layer which is helically applied to the supporting body 5. The layer 6 of the heater coil, with a cross-sectional area of about 0.02 to 0.10 $mm^2$, e.g., 0.06 $mm^2$, may be applied either directly to the rodlike or tubular supporting body 5 or over an intermediate layer 13. (FIG. 1*d*.) Whether an intermediate layer is used or not will depend on the material of the supporting body. If the latter is made of a ceramic or vitrified ceramic material, a metal from the platinum group, for example, or an alloy comprising at least one such metal may be deposited directly on the supporting body, for example, by vapor deposition, sputtering, imprinting, flame spraying, or galvanically or chemically (without the use of electric current), these processes being known as such in thick-film technology. Of course, a layer combination might also be produced in the manner shown in FIG. 1*b*, the inner layer being formed of a high-melting metal or of an alloy comprising at least one such metal, and the cladding being formed of one of the platinum metals or of an alloy of such metals. In the case of a supporting body made of vitreous silica or a high-silica glass, it is recommended that an intermediate layer 13 be used as a barrier layer when a platinum metal is to be applied. The thin layer 6 may also be covered by a surface layer 14 (FIG. 1*c*) which, much like the barrier layer 13, is formed of a ceramic material, and preferably of an aluminum oxide, which is fused on. Surface layer 14 has a cross-sectional area of 0.003 to 0.07 $mm^2$ while barrier layer 13 has a cross-section area of 0.001 to 0.025 $mm^2$. However, the layer 6 may also be enveloped by the ceramic material, a glaze having been found advantageous for this purpose. The layer 6 may then be fired together with the glaze 14. In that case, the layer 6 may be imprinted or brushed on as a suspension and then fired. Chemical compounds which when used in suspension are suitable for currentless coating are known from thick-film technology, as are silk-screen printing pastes. Important is that the firing which follows the application of the layer be carried out at a temperature below the softening temperature of the matrix material. When the layer 6 is completely enveloped by the matrix material, the heater coil may also be applied directly to a metallic supporting body. The material of the terminal pin usually is not suited for this purpose. However, it can be coated with a ceramic material, for example, by flame spraying.

The method by which the heater coil is applied depends mainly on the fabricating properties of the particular platinum-group metal or alloy thereof, or of the combination with the particular high-melting metal or its alloy.

Figure 2:
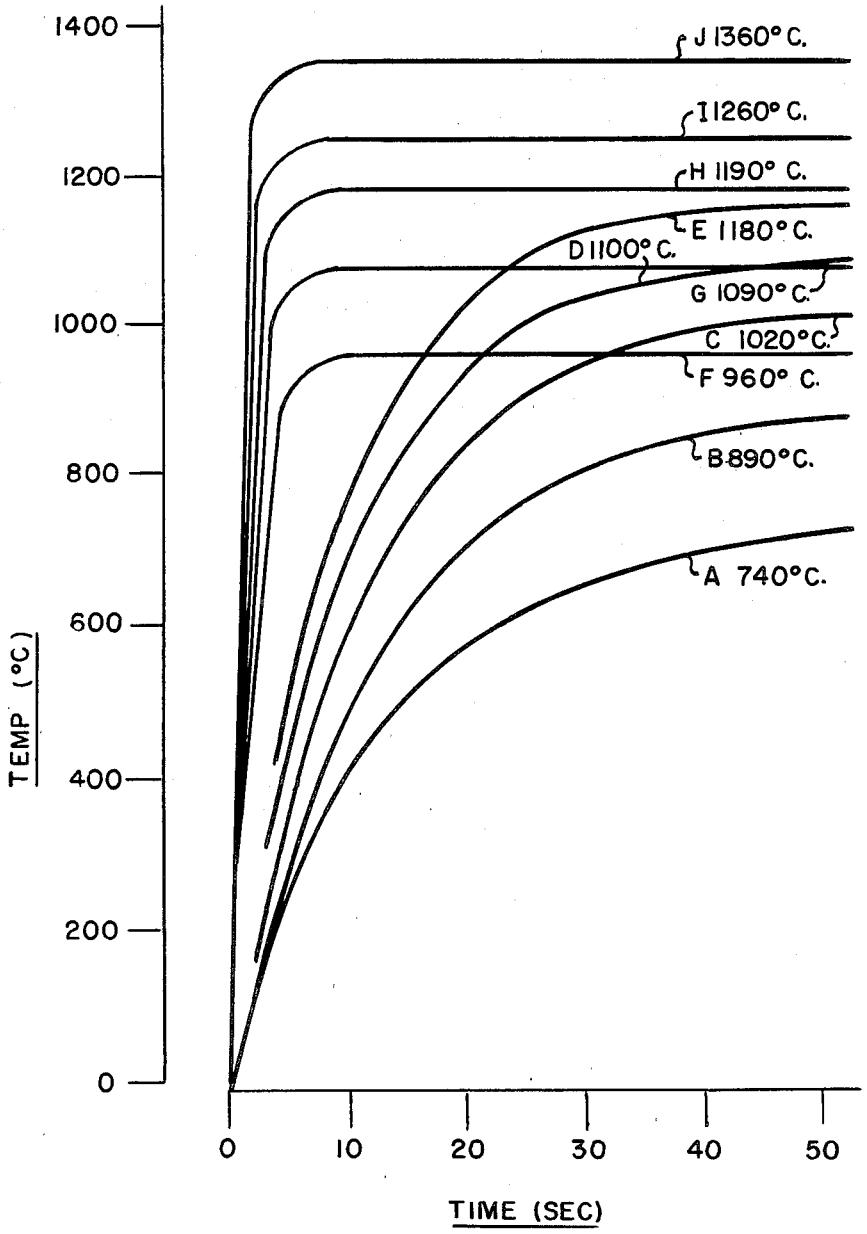
FIG. 2 shows the preheating times obtained with the heater plug in accordance with the invention by comparison with prior-art heater plugs.

The advantages secured by means of the invention are apparent especially from FIG. 2, which shows the temperatures measured on the surface of heater plugs, the time in seconds being given in the abscissa while in the ordinate the temperature, in ° C., is plotted as a function of applied voltage. Curves A to E represent preheating with prior-art heater plugs while curves F to J illustrate preheating with heater plugs in accordance with the invention, with the applied voltage of 6 volts for curve A rising in 2-volt increments to 14 volts for curve E, and analogously for curves F to J.

It is evident that the preheating time can be substantially reduced by means of the invention so that diesel engines can be started much like gasoline engines without a perceptible waiting time and even at temperatures below −20° C. In contrast to the known wire-type heater plugs, the exposed, relatively thin and therefore rather sensitive heater coil of the invention is protected against mechanical damage by a protective tube which extends beyond the supporting body carrying the heater coil.

The fuel or the fuel-air mixture, respectively, may contact the heater coil without the latter having to be provided with special oxidation or corrosion protection since the coil material itself possesses the requisite stability. The heater plug may therefore project directly into the injection jet of the engine.

The formation of a sufficiently ignitable mixture thus is considerably facilitated. Moreover, in contrast to prior-art pin-type heater plugs, the heater coil need not be surrounded in a vibrationproof and electrically insulated manner by a heater tube of compacted insulating powder, which would have the drawback that the entire poorly heat-conducting mass and the tube enveloping it would have to be brought to ignition temperature, which would entail a correspondingly longer preheating time than with the invention.

What is claimed is:

1. A heater plug comprising an electrically conductive heater coil connected to an electrically conductive terminal pin, said terminal pin maintained in gas-tight manner at least in part within and insulated from an electrically conductive plug shell, at least the surface of said heater coil formed of a metal of the platinum group, said heater coil supported by a heat resistant electrically insulating rod-like supporting body attached to said terminal pin, said heater coil being surrounded by a heat resistant electrically conductive protective tube made of metal and electrically connected at its other end to the end of said electrically conductive protective tube, said protective tube having openings over its circumference of number and size sufficient to permit fuel and air to pass to said heater coil, said protective tube having an opening at one end, said electrically conductive heater coil being electrically insulated along said protective tube, except for the terminal connecting portion, the wire of said heater coil comprising a core over which there is disposed a cladding, said cladding having a thickness of from 5 to about 50μ and said core having a diameter of 150 to 400μ.

2. A heater plug according to claim 1 wherein said heater coil is formed by a wire winding on said supporting body.

3. A heater plug according to claim 1 wherein said heater coil is formed of a thin layer applied helically to said supporting body.

4. A heater plug according to claim 1 wherein an intermediate layer is disposed between heater coil and said supporting body, at least over the area of the coil.

5. A heater plug according to claim 1 wherein said heater coil is disposed in a baked-on layer on said supporting body.

6. A heater plug according to claim 1 wherein the heater coil is formed in its entirety of a metal from the platinum group.

7. A heater plug according to claim 1 wherein the heater coil is formed of a high-temperature melting metal selected from the group consisting of niobium, tantalum, molybdenum, and tungsten and is covered with a layer of a metal from the platinum group .

8. A heater plug according to claim 1, further comprising a glass seal disposed in insulating relationship between said terminal pin, said supporting body, and said electrically conductive heating coil on the one hand from said protective tube on the other.

9. A heater plug according to claim 1 wherein said protective tube for the heater coil extends beyond the supporting body and is open at least at the free end of the supporting body.

10. A heater plug according to claim 9 wherein the protective tube is fastened in said plug shell, one end of the heater coil being fastened to the terminal pin.

11. A heater plug according to claim 10, wherein said protective tube is force fitted into said electrically conductive shell.

12. A heater plug according to claim 1 wherein said supporting body is formed of a ceramic material, a quartzose material, vitreous silica, a high-silica glass or a vitrified ceramic material, or has a surface layer of such materials.

13. A heater plug according to claim 1, wherein the wire of said heater coil has a diameter of 200 to 400μ.

14. A heater plug according to claim 13, wherein the wire of the heater coil comprises an alloy of platinum and rhodium, the rhodium content being up to 40 percent by weight.

15. A heater plug according to claim 1, wherein said cladding is made of at least one metal from the platinum group and said core is made of a material selected from the group consisting of molybdenum and tungsten.

16. A heater plug according to claim 15, wherein said core has a diameter of 250 to 300μ.

17. A heater plug according to claim 15, wherein said cladding has a thickness of about 25μ.

18. A heater plug according to claim 1, wherein the heater coil is formed from a layer which is helically disposed on said supporting body, said layer having a cross-sectional area of about 0.02 to 0.10 $mm^2$.

19. A heater plug according to claim 1, wherein said heater coil comprises a core of a ceramic material over which is disposed at least one metal of the platinum group.

20. A heater plug according to claim 1 wherein the metal of said heater coil is in the form of a metal alloy of the platinum group.

21. A heater plug according to claim 1 wherein the metal of said protective tube is in the form of a metal alloy.

22. A heater plug comprising an electrically conductive heater coil connected to an electrically conductive terminal pin, said terminal pin maintained in gas-tight manner at least in part within and insulated from an electrically conductive plug shell, at least the surface of the heater coil formed of a metal of the platinum group, said heater coil supported by a heat-resistant, electrically insulating, tubular supporting body attached to said terminal pin, said heater coil being surrounded by a heat-resistant, electrically conductive protective tube made of a metal and electrically connected at its other end to the end of said electrically conductive protective tube, said protective tube having openings over its circumference of number and size sufficient to permit fuel and air to pass to said heater coil, said protective tube having an opening at one end, said electrically conductive heater coil being electrically insulated along said protective tube, except for the terminal connecting portion, the wire of said heater coil comprising a core over which there is disposed a cladding, said cladding having a thickness of from 5 to about 50μ and said core having a diameter of 150 to 400μ.

23. A heater plug according to claim 22 wherein the metal of said heater coil is in the form of a metal alloy of the platinum group.

24. A heater plug according to claim 22 wherein the metal of said protective tube is in the form of a metal alloy.

25. A heater plug comprising an electrically conductive heater coil connected to an electrically conductive terminal pin, said heater coil being composed of a wire having a diameter of 200 to 400μ which wire comprises a core over which is disposed a cladding, said cladding having a thickness of from 5 to 50μ and being formed of a composition comprising a platinum group metal, said core having a diameter of 150 to 400μ and being made of a composition containing a metal selected from the group consisting of molybdenum and tungsten, said core having a cross-sectional area of about 0.02 to 0.10 $mm^2$, said terminal pin maintained in gas-tight manner at least in part within and insulated from an electrically conductive plug shell, at least the surface of said heater coil being formed of a metal of the platinum group, said heater coil supported by a heat resistant electrically insulating rod-like supporting body attached to said terminal pin, said heater coil being surrounded by a heat-resistant, electrically conductive protective tube made of a metal and electrically connected at its other end to the end of said electrically conductive protective tube, said protective tube having openings over its circumference of number and size sufficient to permit fuel and air to pass to said heater coil, said protective tube having an opening end, said electrically conductive heater coil being electrically insulated along said protective tube, except for the terminal connecting portion.

26. A heater plug comprising an electrically conductive heater coil connected to an electrically conductive terminal pin, said terminal pin maintained in gas-tight manner at least in part within and insulated from an electrically conductive plug shell, at least the surface of said heater coil formed of a metal of the platinum group, said heater coil supported by a heat resistant electrically insulating rod-like supporting body attached to said terminal pin, said heater coil being surrounded by a heat resistant electrically conductive protective tube made of a metal and electrically connected at its other end to the end of said electrically conductive protective tube, said protective tube having openings over its circumference of number and size sufficient to permit fuel and air to pass to said heater coil, said protective tube having an opening at one end, said electrically conductive heater coil being electrically insulated along said protective tube, except for the terminal connecting portion, said heater coil being in the form of a strip which strip comprises a core and a cladding, the core having a cross-sectional area of about 0.02 to 0.10 $mm^2$ and the cladding a thickness of 5 to 50$\mu$.

27. A heater plug according to claim 26, wherein said core comprises a material selected from the group consisting of molybdenum and tungsten and said cladding is formed of at least one metal from the platinum group.

* * * * *